US007367088B2

(12) United States Patent
Pferdmenges et al.

(10) Patent No.: US 7,367,088 B2
(45) Date of Patent: May 6, 2008

(54) APPARATUS AT A CARDING MACHINE HAVING A WEB REMOVAL AND SILVER FORMATION DEVICE

(75) Inventors: Gerd Pferdmenges, Jüchen (DE); Thomas Schmitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 540 days.

(21) Appl. No.: 10/963,610

(22) Filed: Oct. 14, 2004

(65) Prior Publication Data

US 2005/0125956 A1 Jun. 16, 2005

(30) Foreign Application Priority Data

Oct. 16, 2003 (DE) ..... 103 48 690

(51) Int. Cl.
*D01G 27/00* (2006.01)

(52) U.S. Cl. ..... 19/157

(58) Field of Classification Search ..... 19/98, 19/106 R, 157; 57/407
See application file for complete search history.

(56) References Cited

U.S. PATENT DOCUMENTS 4,030,279 A * 6/1977 Rambousek et al. ..... 57/407
4,057,955 A * 11/1977 Roehrich ..... 57/302
4,112,659 A * 9/1978 Stahlecker et al. ..... 57/407
4,213,553 A * 7/1980 Leifeld ..... 226/196.1
4,404,711 A * 9/1983 Kluttermann ..... 19/106 R
5,016,322 A * 5/1991 Erni et al. ..... 19/150
6,345,417 B2 * 2/2002 Leder et al. ..... 19/150

FOREIGN PATENT DOCUMENTS

DE 80 25 962 U1 2/1981
DE 39 13 548 C2 10/1990
DE 197 39 185 A1 3/1999
DE 100 51 998 A1 1/2002

* cited by examiner

*Primary Examiner*—Shaun R. Hurley
(74) *Attorney, Agent, or Firm*—Venable LLP; Robert Kinberg; Steven J. Schwarz

(57) ABSTRACT

In an apparatus at a carding machine having a web removal and sliver formation device, there are provided, following on from the web removal device, a web funnel and a pair of draw-off rollers, which are arranged to pivot together with a rotary mounting. In order to provide an apparatus which is dimensionally stable and which facilitates servicing work, the web-guiding element, on the one hand, and the web funnel together with the pair of draw-off rollers, on the other hand, are arranged to pivot separately about the rotary mounting and are connected to one another by a locking and unlocking device.

22 Claims, 4 Drawing Sheets

APPARATUS AT A CARDING MACHINE HAVING A WEB REMOVAL AND SILVER FORMATION DEVICE

CROSS REFERENCE TO RELATED APPLICATION

This application claims priority from German Patent Application No. 103 48 690.9 dated Oct. 16, 2003, the entire disclosure of which is incorporated herein by reference.

BACKGROUND OF THE INVENTION

The invention relates to an apparatus at a carding machine having a web removal and sliver formation device, wherein there are provided, following on from the web removal device, a web-guiding element, a web funnel and a pair of draw-off rollers (calender rollers), which are arranged to pivot about a rotary mounting.

In a known apparatus, a screw connection is provided between the web-guiding element, the draw-off rollers (calendering mechanism) and the draw-off roller covering. In order to be able to carry out maintenance and servicing work on the calendering mechanism, the screw connections have to be released and removed, which can be done only by using tools. Because the fastening is screwed through several components in succession and consists partly of sheet metal edge parts, dimensional discrepancies can occur in the spacing dimension between the web-guiding element and the associated nip roller. Even when the web-guiding element (for example "Webspeed" web-guiding device) is completely disassembled, the accessibility of the calendering rollers (draw-off rollers) is still inadequate.

It is an aim of the to provide an apparatus of the kind described at the beginning which avoids or mitigates the mentioned disadvantages and which especially is dimensionally stable and facilitates maintenance and servicing work.

SUMMARY OF THE INVENTION

The invention provides a web removal and sliver formation device for a carding machine, having a web-guiding element, a web funnel and a pair of calender rolls, in which:

the device comprises a rotary mounting the web-guiding element, the calender rolls and the web funnel are pivotable about the rotary mounting the web-guiding element is pivotable about the rotary mounting separately from the calender rolls and the web funnel; and the device further comprises a locking and unlocking device for permitting the web-guiding element to be held in connection with the calender rolls and web funnel.

In accordance with the invention, a separate linkage of the web-guiding element (for example, Webspeed) about an axis of rotation, preferably about the table shaft, is provided. By that means, the web-guiding element, on the one hand, and the web funnel together with the draw-off rollers, on the other hand, can be rotated about the rotary mounting both individually and also together, thereby providing a stationary rotatable linkage in the machine (carding machine). Servicing work is possible without disassembly of the web-guiding element at the calendering mechanism. Maintaining the prespecified spacing dimension of the web-guiding element with respect to the nip roller is made possible by means of the constructional arrangement. Pivoting up of the web-guiding element can be assisted and limited by means of, for example, a pneumatic spring. Opening and closing can be carried out without expending a major amount of force. Advantageously, opening is achieved merely by actuation of a push button. Preferably, the torsional rigidity is substantially increased by incorporating a rectangular tube. Preference is given to providing the web-guiding element with fine adjustment of the functional edge (spacing between the web-guiding element and nip roller).

The rotary mounting may be the table shaft, which may be arranged at the exit from the carding machine. The web funnel together with the draw-off rollers may be arranged in a housing. The mountings of the draw-off rollers may be fastened in a housing element (holding element). The housing element may be connected to the table shaft for conjoint rotation therewith, for example by means of screws. The arrangement may be such that the housing element and the table shaft necessarily rotate together with one another. The housing element, the draw-off rollers and the web funnel may be rotatable together with the table shaft. The web-guiding element may, by means of at least one mounting element, be mounted so as to be rotatable about the table shaft. At least one mounting element may be fastened to the web-guiding element, for example by means of screws. The locking and unlocking device may comprise a passive engagement element, for example a hoop, an eyelet or the like. The locking and unlocking device may comprise an active engagement element, for example a hook, a finger or the like. The hook or the like may be mounted on a rotary mounting. The hook or the like may be resiliently biased, for example by means of a spring. The passive engagement element may be mounted on the web-guiding element. The active engagement element may be mounted on the housing for the draw-off rollers. A spring-loaded push actuator may be associated with the hook or the like. A rectangular tube may be associated with the web-guiding element. The web-guiding element may be provided with a device for fine adjustment of the functional edge (spacing "a" between the web-guiding element and nip rollers, shown, for example, in FIG. 2*a*).

The invention also provides an apparatus at a carding machine having a web removal and sliver formation device, wherein there are provided, following on from the web removal device, a web funnel and a pair of draw-off rollers, which are arranged to pivot together about a rotary mounting, characterised in that the web-guiding element, on the one hand, and the web funnel together with the pair of draw-off rollers, on the other hand, are arranged to pivot separately about the rotary mounting and are connected to one another by means of a locking and unlocking device.

DETAILED DESCRIPTION OF PREFERRED EMBODIMENTS

Figure 1:
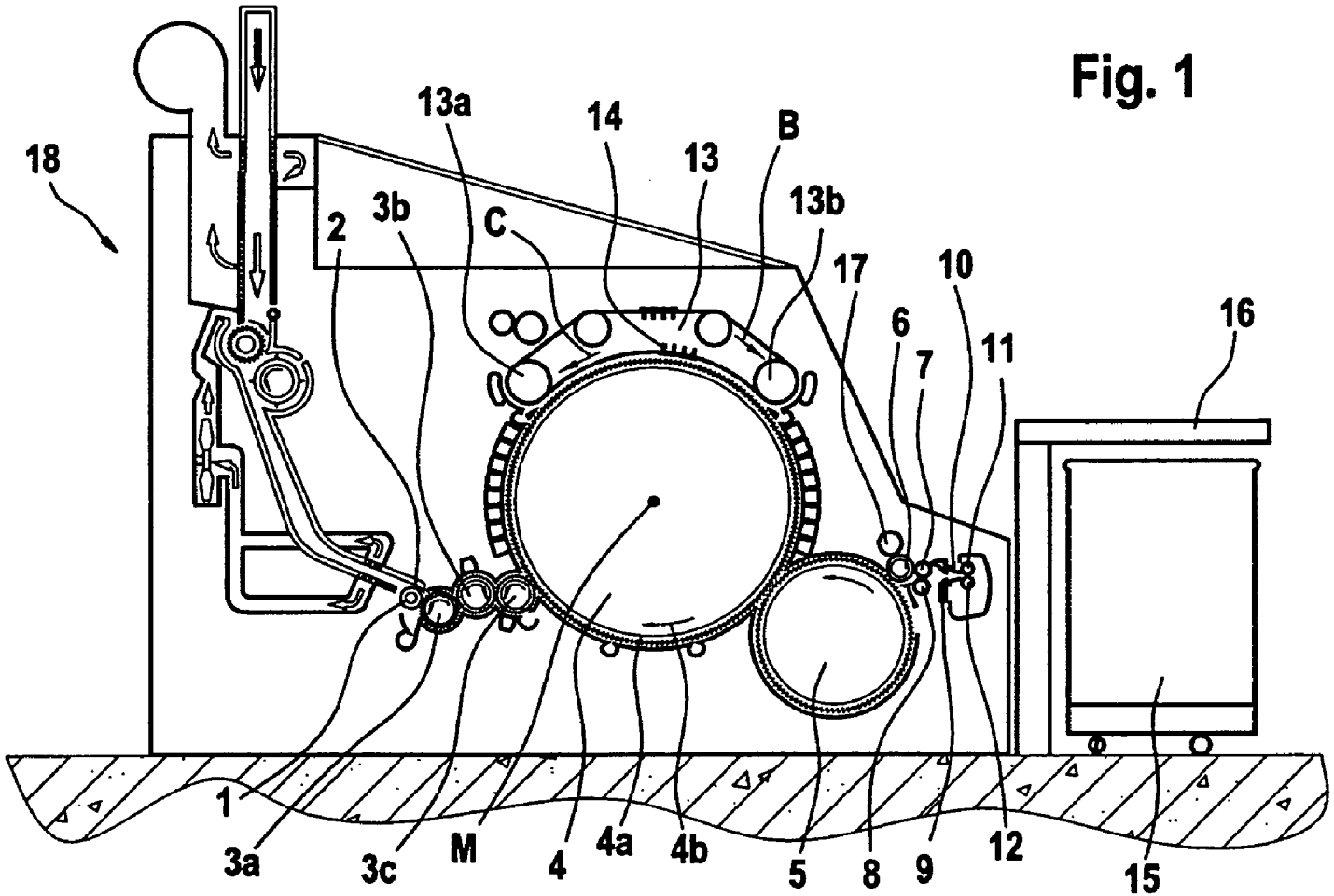
FIG. 1 is a diagrammatic side view of a carding machine having calendering assembly according to the invention.

With reference to FIG. 1, a carding machine, for example a TC 03 carding machine made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers (calender rollers) 11, 12, revolving card top 13 having card-top-deflecting rollers 13*a*, 13*b* and card top bars 14, can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. Reference letter C denotes the direction of rotation of the revolving card top 13 at the carding location and reference letter B denotes the direction in which the card top bars 14 are moved on the reverse side. Reference numeral 18 denotes a card feeder. The housing inside which the draw-off rollers 11, 12 and the web funnel 10 are arranged is denoted by reference numeral 25.

Figure 2A:
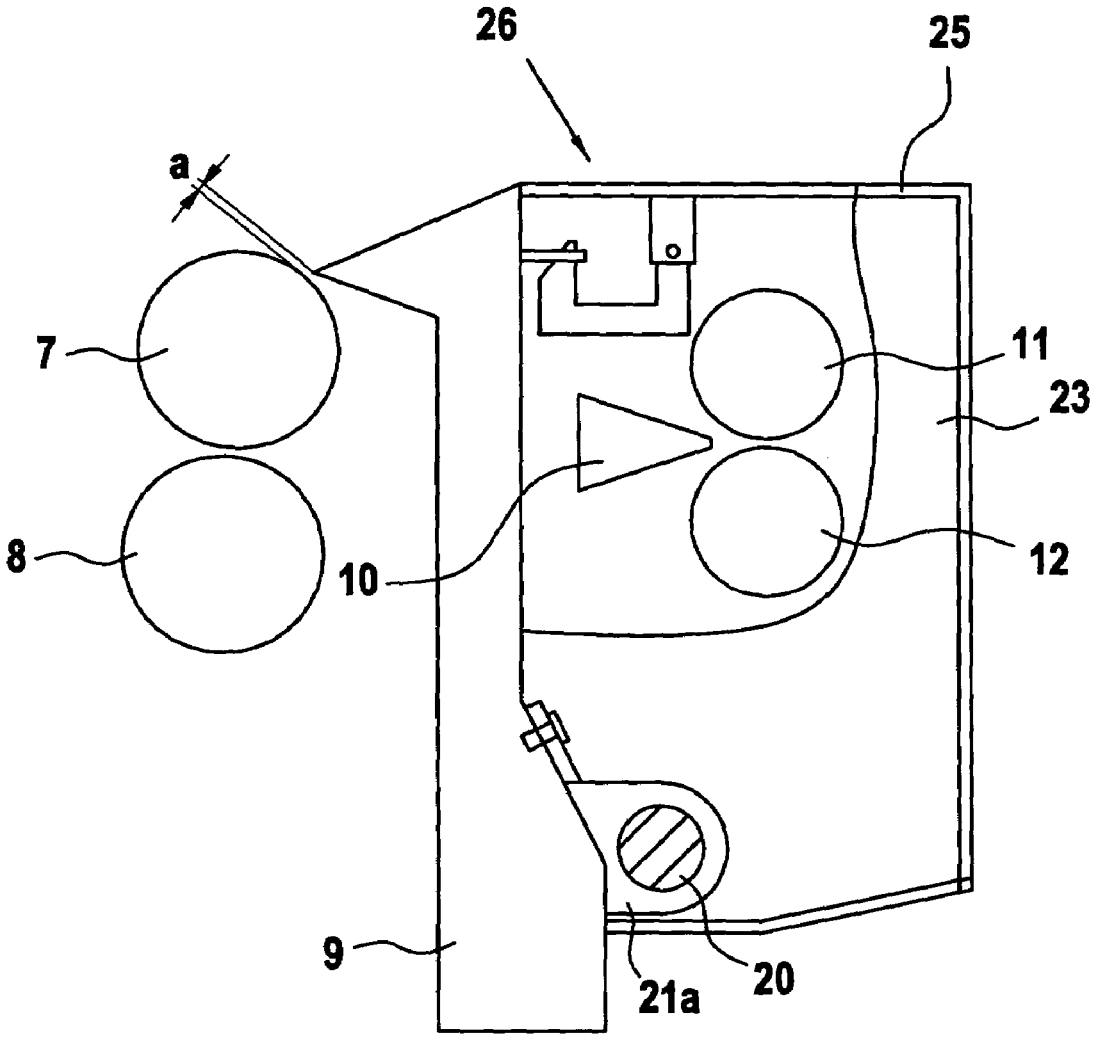
FIG. 2*a* is a side view of a calendering assembly according to the invention, wherein the web-guiding element, on the one hand, and the draw-off rollers together with the web funnel, on the other hand, are in the operational position.

FIG. 2*a* shows the calendering assembly of FIG. 1 in the operational position. (The fibre web and fibre sliver are known per se and not shown.) Following on from the nip rollers 7, 8, there are provided the web-guiding element 9, the web funnel 10 and the pair of draw-off rollers 11, 12. The pair of draw-off rollers 11, 12 and the web funnel 10 are arranged at a housing 25, for example made from sheet metal. In accordance with FIG. 2*b*, the web-guiding element 9 and the housing 25 are fixedly connected (locked) to one another by means of the locking and unlocking device 26 and as a result thereof have together been rotated in direction Q by means of rotation of the table shaft 20. In accordance with FIG. 2*c*, the locking and unlocking device 26 has been unlocked so that the web-guiding element 9 and the housing 25 have been separated from one another. The web-guiding element 9 has been pivoted back in direction F into the operational position, whereas the housing 25 remains in the rotated position. It is also possible for the web-guiding element 9 to remain in the operational position and the housing 25 to be pivoted in direction G. The rear face 9*a* of the web-guiding element 9 closes off the face 25*a* of the housing 25 in accordance with FIGS. 2*a*, 2*b*, whereas in accordance with FIG. 2*c* the face 25*a* is open and, as a result, is accessible for servicing and maintenance work, for example on the web funnel 10 or rollers 11, 12.

Figure 2B:
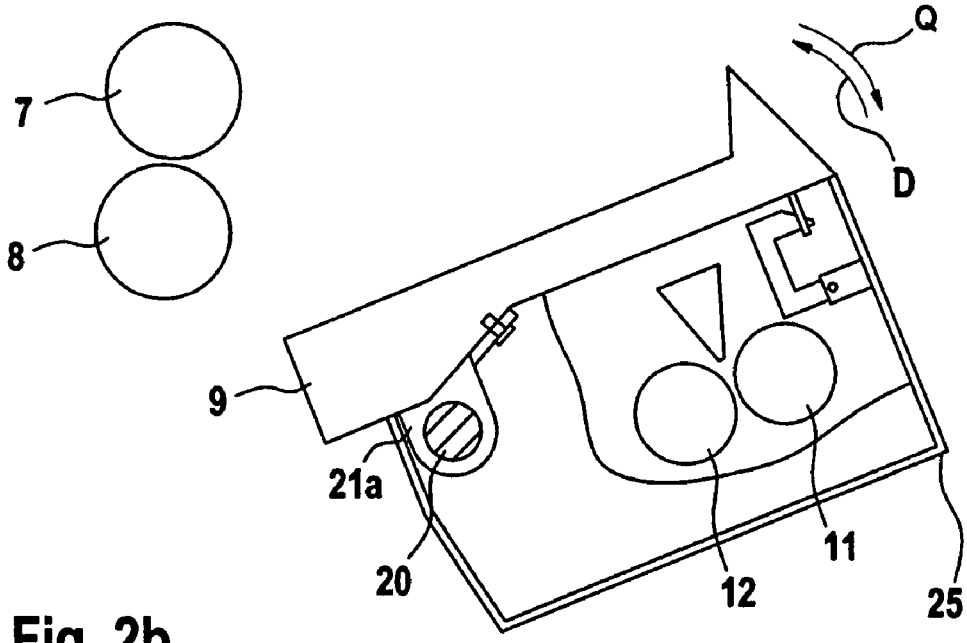
FIG. 2*b* is a side view of the assembly of FIG. 2*a*, wherein the components have been rotated all together about the table shaft.
Figure 2C:
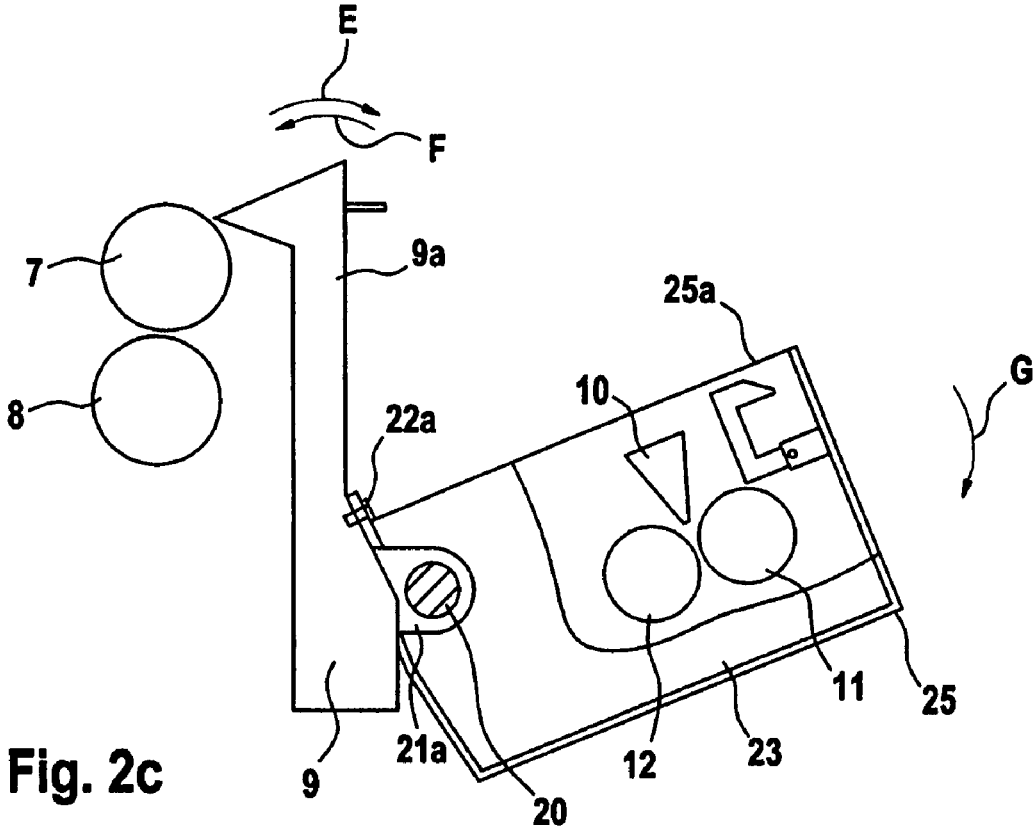
FIG. 2*c* is a side view of the assembly of FIG. 2*a*, in which the web-guiding element has been rotated back into the operational position while the draw-off rollers together with the web funnel remain rotated about the table shaft.
Figure 3:
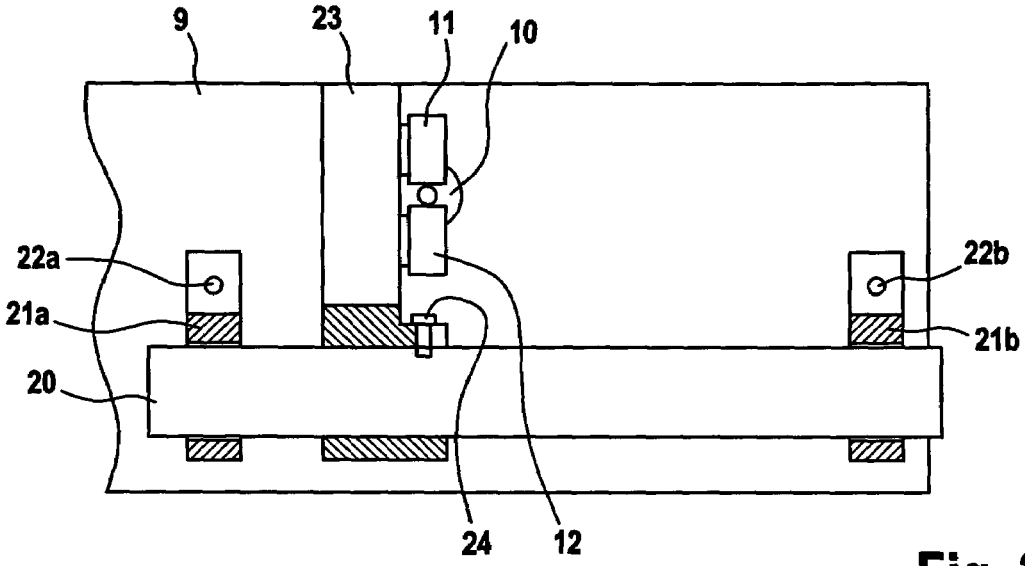
FIG. 3 is a diagrammatic front view of the linkage of the web-guiding element, on the one hand, and the draw-off rollers together with the web funnel, on the other hand, to the table shaft.

According to FIG. 3, the mountings of the draw-off rollers 11, 12 are fastened in a mounting element 23, for example a cast mounting. The mounting element 23 is connected, by means of screws 24, to the table shaft 20 for conjoint rotation therewith. As a result, the table shaft 20 and the mounting element 23 (and, together with the latter, the rollers 11, 12 and the web funnel 10) are necessarily rotated together. The table shaft 20 is rotated—in a manner not shown—by means of a drive motor and transmission elements, for example a pneumatic cylinder, or electric motor provided with toothed belts. Two mounting elements 21*a*, 21*b* are fastened to the rear face 9*a* of the web-guiding element 9 by means of screws 22*a* and 22*b*, respectively. The mounting elements 21*a*, 21*b* are arranged to be loosely rotatable about the table shaft 20 (see FIGS. 2*b* and 2*c*, arrows Q, D and E, F).

Figure 4:
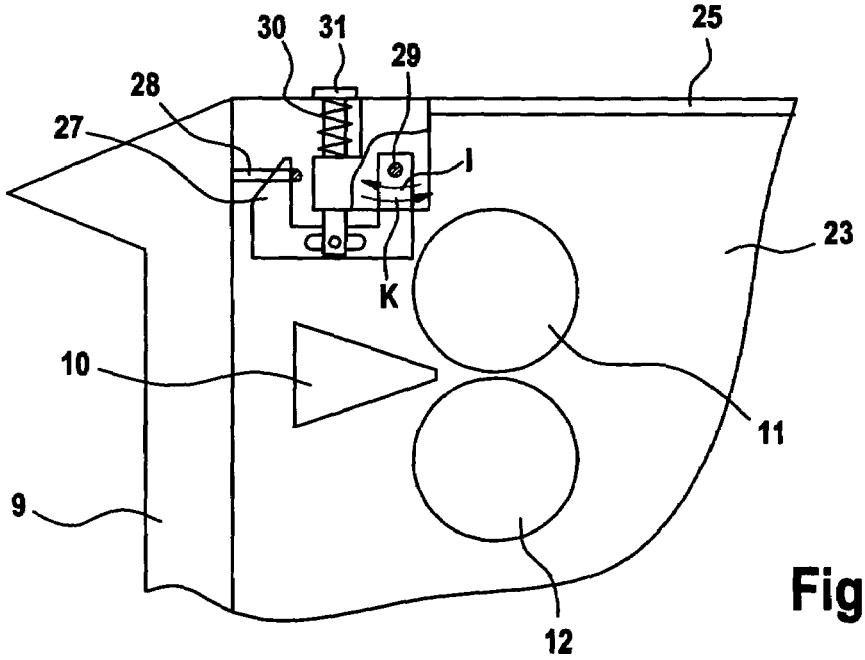
FIG. 4 shows the locking and unlocking device.

FIG. 4 shows one form of locking arrangement suitable for use in the assembly of FIGS. 2*a* to 2*c*. There is fastened to the rear face 9*a* of the web-guiding element 9 a hoop 28, through the opening of which the free end of an angular hook 27 can engage. The other end of the hook 27 is rotatably mounted in a rotary mounting 29 (see curved arrows I, K), which is fastened to the housing 25. Coupled to the hook 27 is a push rod 31, which is biased by a compression spring 30. As a result of manual pressure on the push rod 31, the free end of the hook 27 is rotated about the rotary mounting 29 and, as a result, the hook 27 is pushed out from the hoop 28. As a result, the locking and unlocking device 26 is unlocked (see FIG. 2*c*).

Although the foregoing invention has been described in detail by way of illustration and example for purposes of understanding, it will be obvious that changes and modifications may be practiced within the scope of the appended claims.

What is claimed is:

1. A web removal and sliver formation device for a carding machine, comprising:

a web-guiding element, a web funnel, a pair of calender rolls, a rotary mounting, and a locking and unlocking device adapted to hold the web-guiding element in connection with the calender rolls and web funnel, and wherein the web-guiding element, the calender rolls and the web funnel are pivotable about the rotary mounting, further wherein the web-guiding element is pivotable about the rotary mounting separately from the calender rolls and the web funnel.

2. A device according to claim 1, in which the rotary mounting is a shaft.

3. A device according to claim 2, in which the shaft is arranged at the exit from the carding machine.

4. A device according to claim 2, further comprising a housing element in which the mountings of the draw-off rollers are fastened.

5. A device according to claim 4, in which the housing element is connected to the shaft for conjoint rotation therewith.

6. A device according to claim 4, in which the housing element and the shaft necessarily rotate together with one another.

7. Apparatus according to claim 4, in which the housing element, the calender rollers and the web funnel are rotatable together with the shaft.

8. A device according to claim 2, in which the web-guiding element is, by means of at least one mounting element, mounted so as to be rotatable about the shaft.

9. A device according to claim 1, in which at least one mounting element is fastened to the web-guiding element.

10. A device according to claim 1, further comprising a housing in which the web funnel together with the draw-off rollers are arranged.

11. A device according to claim 1, in which the locking and unlocking device comprises a passive engagement element.

12. A device according to claim 11, in which the passive engagement element comprises a hoop eyelet.

13. A device according to claim 11, in which the locking and unlocking device comprises an active engagement element.

14. A device according to claim 13, in which the active engagement element comprises a hook, or finger.

15. A device according to claim 13, in which the active engagement element is mounted on a rotary mounting.

16. A device according to claim 13, in which the active engagement element is resiliently biased.

17. A device according to claim 11, in which the passive engagement element is mounted on the web-guiding element.

18. A device according to claim 13, in which the active engagement element is mounted on the housing for the draw-off rollers.

19. A device according to claim 13, in which a spring-loaded push actuator is associated with the active engagement element.

20. A device according to claim 1, in which a rectangular tube is associated with the web-guiding element.

21. A device according to claim 1, in which the web-guiding element is provided with a device for fine adjustment of a spacing between the web-guiding element and nip rollers.

22. A web removal and sliver formation device for a carding machine comprising:

a web removal device, a web funnel, a pair of draw-off rollers, which are arranged to pivot together about a rotary mounting, and a web-guiding element arranged to pivot about the rotary mounting, wherein the web funnel together with the pair of draw-off rollers are arranged to pivot about the rotary mounting separately from the web-guiding element, and further wherein the web funnel together with the pair of draw-off rollers are connected to the web guiding element by a locking and unlocking device.

* * * * *